US005895283A

United States Patent [19]

Takanashi

[11] Patent Number: 5,895,283

[45] **Date of Patent: *Apr. 20, 1999**

[54] BULB SOCKET

[75] Inventor: Hitoshi Takanashi, Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/559,725

[22] Filed: Nov. 15, 1995

[30] Foreign Application Priority Data

Dec. 22, 1994 [JP] Japan ..... 6-336190

[51] Int. Cl.[6] ..... H01R 4/50

[52] U.S. Cl. ..... 439/336; 439/699.2

[58] Field of Search ..... 439/336, 611–619, 439/699.2

[56] References Cited

U.S. PATENT DOCUMENTS

| | | | |
|---|---|---|---|
| 4,758,181 | 7/1988 | Reedy | 439/336 |
| 4,804,343 | 2/1989 | Reedy | 439/336 |
| 4,902,251 | 2/1990 | Grzena | 439/699 |
| 5,087,213 | 2/1992 | Drapcho et al. | 439/336 |
| 5,538,443 | 7/1996 | Inoue et al. | 439/699.2 |

FOREIGN PATENT DOCUMENTS

| | | |
|---|---|---|
| 0594060 | 4/1994 | European Pat. Off. . |
| 0597466 | 5/1994 | European Pat. Off. . |
| 2702601 | 9/1994 | France . |
| 2214364 | 8/1989 | United Kingdom . |

OTHER PUBLICATIONS

Japanese Utility Model Public Disclosure No. 64–29794.

*Primary Examiner*—Hien Vu

*Attorney, Agent, or Firm*—John B. Bierman; Bierman, Muserlian and Lucas

[57] ABSTRACT

A bulb socket which can receive both a round base bulb and a wedge base bulb. A bulb-receiving portion (23) is provided in its interior with a pair of bulb insertion grooves (26) which are symmetrically spaced at an angle of 180°. The groove (26) has a guide portion (27) extending axially from an open edge to an inner part and an engaging portion (28) turning circumferentially at an inner end of the guide portion (27). A pair of projections on the base of the round base bulb are inserted into and secured to the bulb insertion grooves (26), respectively. Opposite side edges of a base of the wedge base bulb are inserted into and secured to the guide portions (27), respectively. The bulb-receiving portion (23) is provided in its interior with contact piece insertion grooves (30*a*, 30*b*) which receive a pair of positive and negative contact pieces for the round base bulb and a pair of positive and negative contact pieces for the wedge base bulb and which are disposed symmetrically at positions shifted circumferentially from the respective bulb insertion grooves (26).

4 Claims, 10 Drawing Sheets

BULB SOCKET

BACKGROUND OF THE INVENTION (1) Field of the Invention

This invention relates to a bulb socket which can receive both a round base bulb and a wedge base bulb.

(2) Statement of the Prior Art

Heretofore, two kinds of bulbs have been used in lighting fixtures for an automobile, namely a round base bulb and a wedge base bulb. The round base bulb includes a glass bulb body which accommodates a filament, a round base attached to a lower end of the bulb body, and positive and negative contacts provided on an end face and a peripheral face of the base. The wedge base bulb includes a glass bulb body which accommodates a filament, a flat base attached to a lower end of the bulb body, a pair of lead wires which are connected to the opposite ends of the filament and drawn out of a lower end of the base, and positive and negative contacts which are formed by turning an end of each lead wire onto a side face of the base so that the respective ends are disposed on opposite sides. These bulbs are inserted into the respective bulb receiving holes so that the respective contacts of the bulbs contact with the respective contact pieces mounted in the respective holes.

Since the round base bulb is different from the wedge base bulb with respect to a configuration of a base to be inserted into the bulb, a configuration and an arrangement of contacts on the base and a configuration of contact pieces to be contacted with the contacts, configurations of the bulb sockets to receive the bulbs and contact pieces are naturally different from each other.

Accordingly, conventional bulb sockets for the round base bulb and the wedge base bulb had different structures. However, it will be preferable for the respective bulb socket to receive both kinds of bulb in order to lower production costs.

SUMMARY OF THE INVENTION

An object of the present invention is to provide a bulb socket which can receive both a round base bulb and a wedge base bulb.

In order to achieve the above object, a bulb socket of the present invention comprises a socket body. The socket body is provided in an end thereof with: a bulb receiving hole adapted to selectively hold a base of a round base bulb or a base of a wedge base bulb; a pair of bulb insertion grooves having a portion extending axially from an open edge to an inner part in an interior of the bulb receiving hole; and a portion extending axially in each of the grooves adapted to hold a pair of projections formed on the base of the round base bulb and opposite ends of the base of the wedge base bulb.

The bulb receiving hole is provided with a common contact piece holder adapted to hold both pairs of positive and negative contact pieces for the round base bulb and the wedge base bulb.

A positive side contact piece out of a pair of positive side and negative side contact pieces for the round base bulb includes an L-shaped body in plan view, an S-shaped contact part which is provided on an upper face of one leg of the body and adapted to resiliently contact with a positive side contact on the base of the round base bulb, and a tab which extends downwardly from the other leg of the body. The contact piece is formed from a sheet of metal together with each part by press working. The body is provided on one leg thereof with an engaging piece formed by cutting and bending and on the other leg thereof with a short fitting part which extends perpendicularly to the other leg. The negative side contact piece includes an L-shaped body in plan view and a tab which is provided on one leg to extend downwardly. The contact piece is formed of a sheet of metal together with each part by a press work. The body is provided on an upper face of the other leg thereof with a tall fitting part which extends perpendicularly to the other leg. The fitting part is provided on an upper side with a tongue-like connection part which is cut and bent up inwardly to resiliently contact with a peripheral face of a negative side contact on the base of the round base bulb. The body is also provided with an engaging piece.

A pair of positive side and negative side contact pieces for the wedge base bulb are of the same configuration in both positive and negative sides. Each contact piece includes an L-shaped body in plan view, a tab which is provided on one leg of the body to project downwardly, and a tall fitting part which is provided on an upper face of the other leg of the body perpendicularly. The body is provided on an upper face of a bent portion of the body with a tall stopper and a short connection piece which are juxtaposed on the upper face. The contact piece is formed of a sheet of metal together with each part.

A positive side contact piece holder out of the pair of positive side and negative side contact piece holders is formed into a positive side contact piece insertion groove adapted to receive the positive side contact piece which is provided in a thicker wall with an introducing passage which extends axially from the open edge of the bulb receiving portion to the bottom face to receive the fitting part of the contact piece and is provided with a narrow channel which is opened in an interior of the bulb receiving portion to pass a proximal end of the body through a lateral center part of the introducing passage. The bulb receiving portion is provided in the bottom face with an introducing slot which is communicated with the channel to receive the body and is also provided in the bottom face with a through-hole which is adapted to pass the tab. The negative side contact piece holder is formed into the negative side contact piece insertion groove adapted to receive the negative side contact piece which is provided in the thicker wall with an introducing passage which extends axially from the open edge of the bulb receiving portion to the bottom face to receive the fitting part of the contact piece and is provided with a wide channel which is opened in an interior of the bulb receiving portion from the lateral center part of the passage. The channel permits a proximal end of the body to pass therethrough and a tongue-like connection part to project inwardly therethrough. The bulb receiving portion is provided in the bottom face with an introducing slot which is communicated with the channel and is also provided with a through-hole which is adapted to pass the tab.

In the case of attaching the round base bulb to the bulb socket of the present invention, a pair of projections on the base are inserted into extensions which extend axially in the bulb insertion grooves. On the other hand, in the case of attaching the wedge base bulb to the bulb socket, the opposite ends of the base are inserted into extensions which extend axially in the bulb insertion grooves.

A pair of positive and negative contact pieces for the round base bulb and a pair of positive and negative contact pieces are received in the common contact piece holder in the bulb receiving hole.

Since the common bulb socket for the round base bulb and the wedge base bulb is provided in accordance with the present invention, the number of parts is reduced and the cost is greatly lowered.

Further, since the contact piece holders are made common, the structure of the bulb socket is simplified and the production cost is lowered.

DETAILED DESCRIPTION OF THE PREFERRED EMBODIMENTS

An embodiment of a bulb socket in accordance with the present invention will be described below by referring now to FIGS. 1 through 21.

Figure 3:
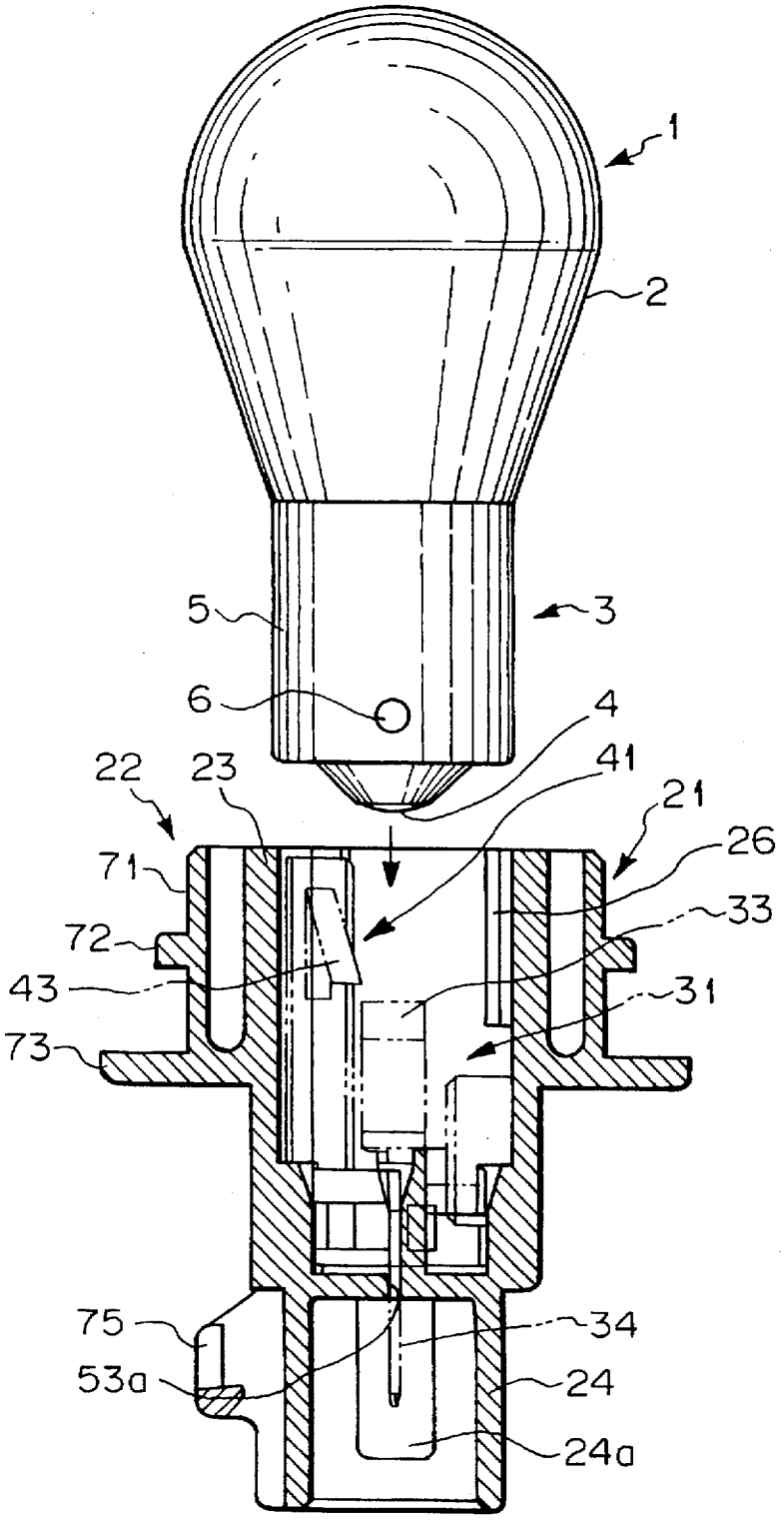
FIG. 3 is a front elevational view of a round base bulb and a longitudinal sectional view of the bulb socket taken along line III—III in FIG. 1, illustrating a contact piece which is inserted in the bulb socket.

A round base bulb 1, as shown in FIG. 3, includes a bulb body 2 accommodating a filament, a round base 3 mounted on a lower end of the bulb body 2, a positive side contact 4 mounted on an end face of the base 3, and a negative side contact formed on an outer peripheral face of the base 5. The base 3 is provided on its outer peripheral end face with a pair of projections 6 which are spaced circumferentially at an angle of 180° to be engaged with a bulb socket 21.

Figure 12:
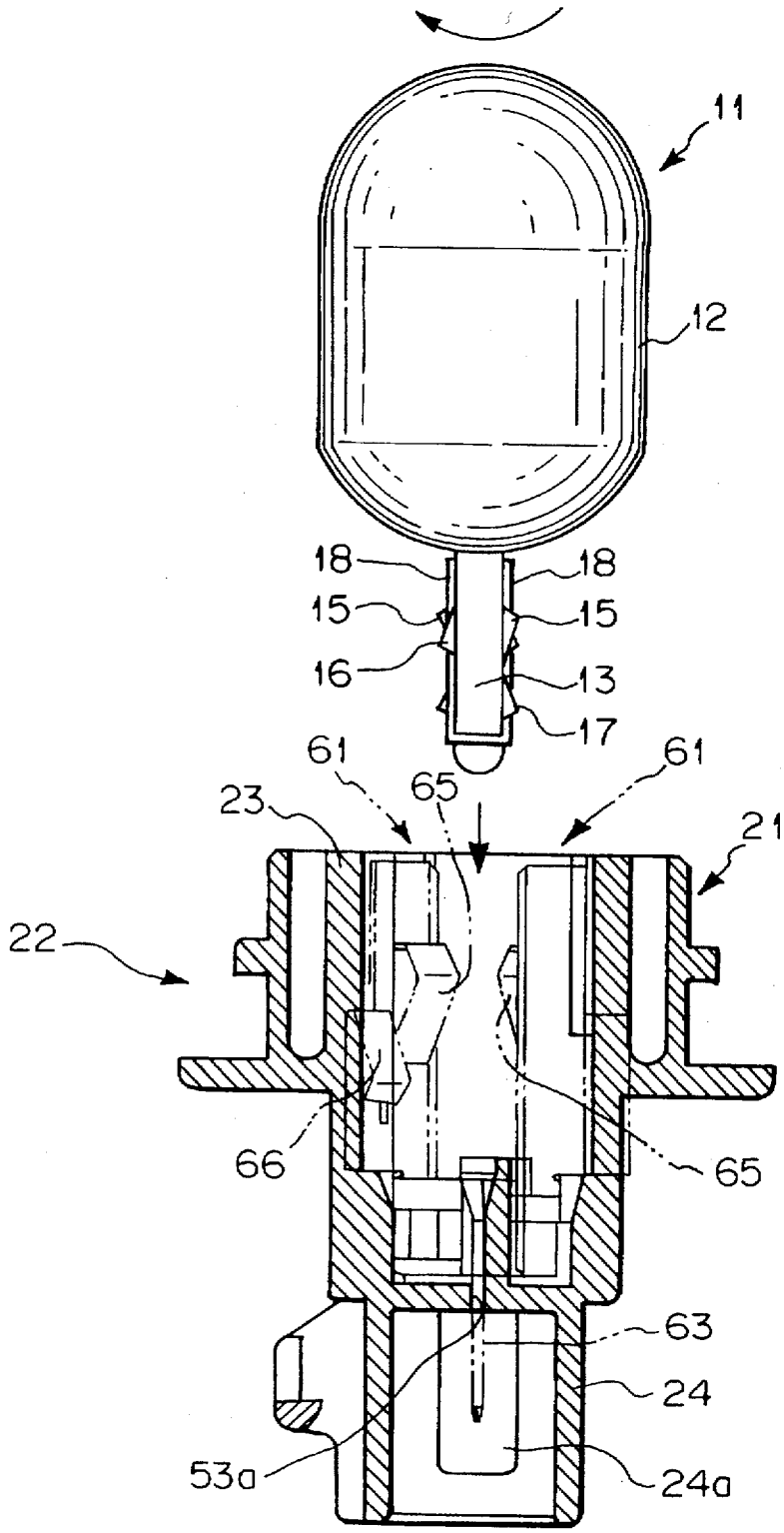
FIG. 12 is a front elevational view of a wedge base bulb and a longitudinal sectional view of the bulb socket taken along line X—X in FIG. 1, illustrating a contact piece which is inserted in the bulb socket.
Figure 13:
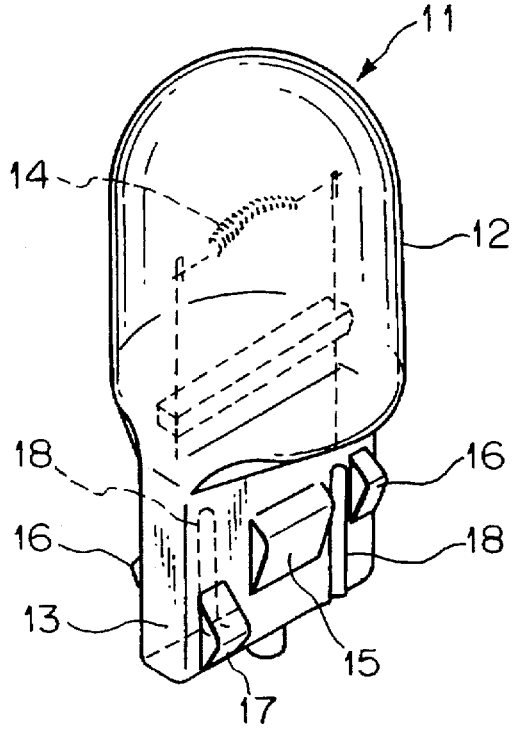
FIG. 13 is a perspective view of the wedge base bulb.
Figure 19:
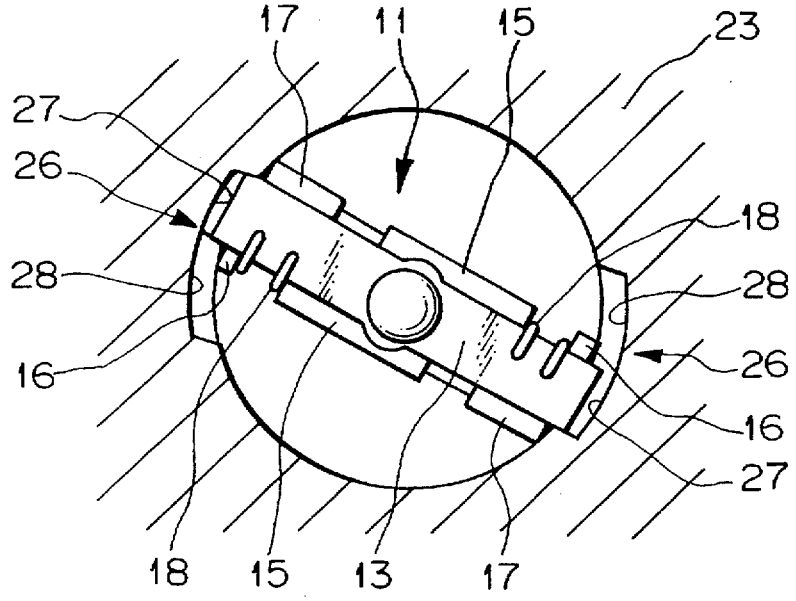
FIG. 19 is a cross sectional view taken from the bottom side of the bulb socket in which the wedge base bulb is inserted.

A wedge base bulb 11 is shown in FIGS. 12 and 13. The wedge base bulb 11 includes a bulb body 12 accommodating a filament 14 and a flat base 13 united with a lower end of the bulb body 12. A width of the base 13 is the same distance as that between the projections 6 on the base 3 of the round base bulb 1. As shown in FIG. 19, the opposite ends of the base 13 are adapted to enter into guide parts 27 in bulb insertion grooves 26 in the bulb socket 21 described hereinafter.

The base 13 is provided on its opposite side faces with first projections 15 which serve to prevent the bulb 11 from coming out of the socket 21. Each projection 15 is disposed on a central portion of each side face of the base 13 symmetrically with respect to the center of the base 13 (see FIG. 19). Second projections 16 and third projections 17 are disposed adjacent to the opposite ends of the base 13 on each side face of the base 13 symmetrically with respect to the center of the base 13. The second projection 16 is disposed in the substantially same position as that of the first projection 15 at a height from the lower end of the base 13. The third projection 17 is disposed in a lower position than the first projection 15 at the height. A pair of lead wires which are connected to the opposite ends of the filament 14 are drawn from the lower end of the base 13 in a form of a loop and are turned up on the respective side faces of the base 13 so that a distal end of each lead wire is disposed between the first projection 15 and the second projection 16. The turned-up lead wires serve as positive and negative contacts 18, 18, respectively. The third projections 17, as shown in FIG. 19, together with the second projection 16 contact closely with the interior in a bulb receiving portion 23 to eliminate any plays between the base 13 and the socket 21 in a width direction of the base.

Figure 1:
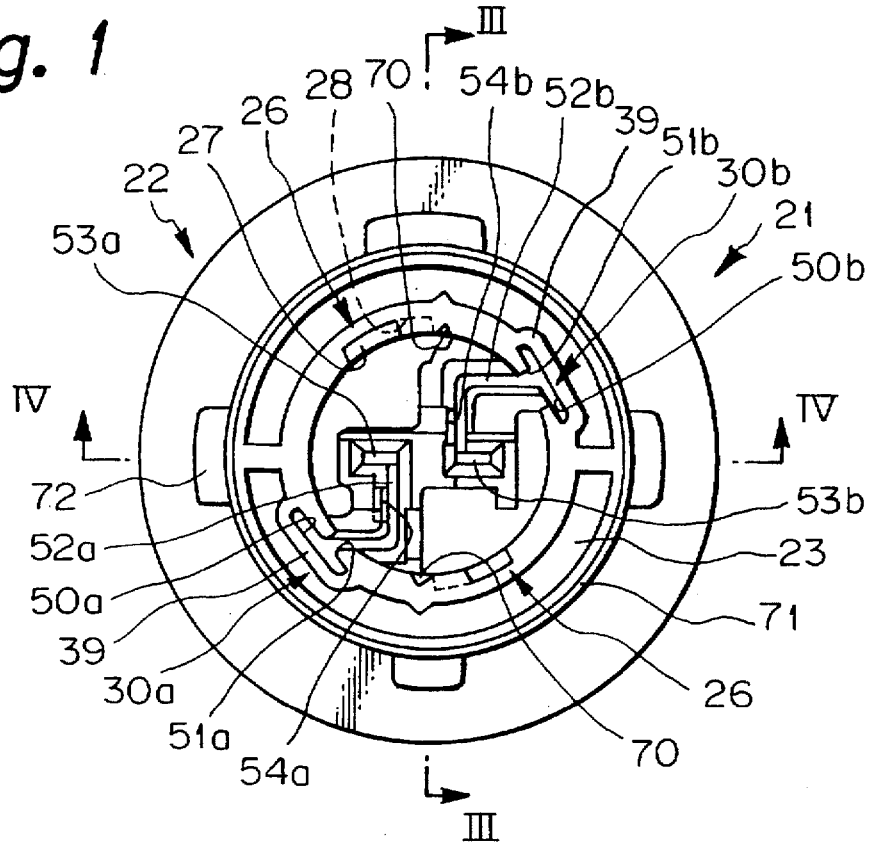
FIG. 1 is a plan view of an embodiment of a bulb socket of the present invention.
Figure 2:
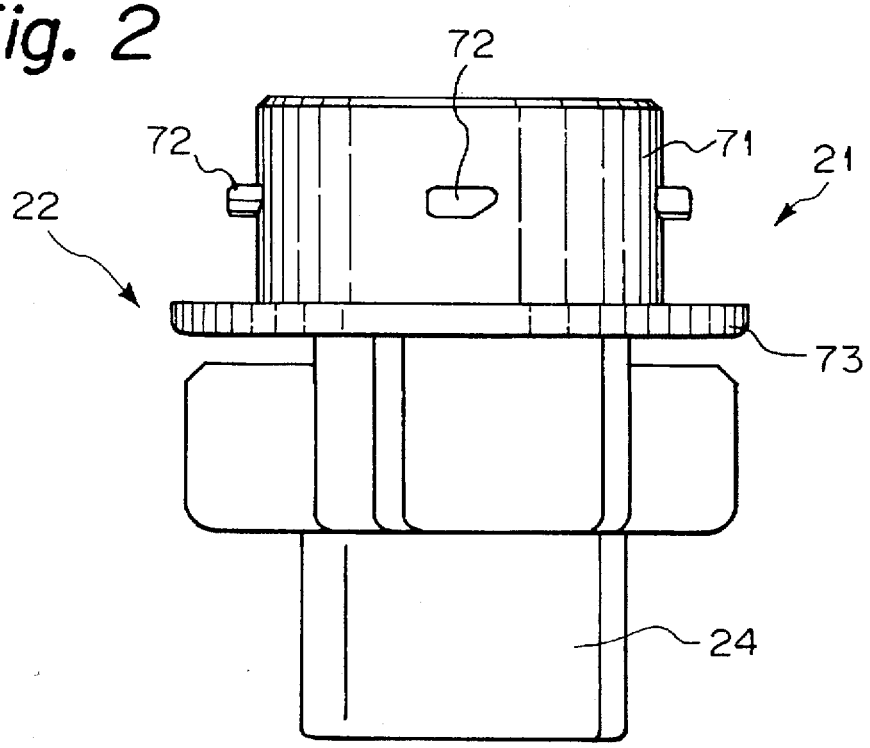
FIG. 2 is a front elevational view of FIG. 1.

The bulb socket 21 includes a socket body 22 made of a synthetic resin material. As shown in FIGS. 1 to 3, the bulb socket 21 is provided on its one end with the cylindrical bulb receiving portion 23 and on its other end with a rectangular male connector portion 24 adapted to couple to a female connector not shown.

Figure 4:
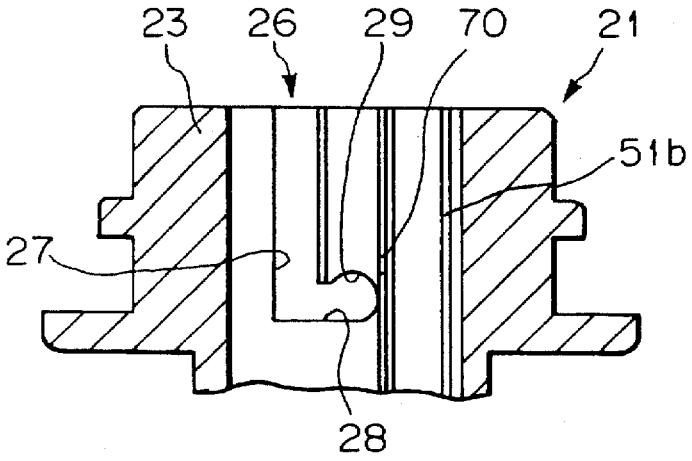
FIG. 4 is a fragmentary sectional view of the bulb socket taken along line IV—IV in FIG. 1.

The bulb receiving portion 23 is provided in its interior with a pair of bulb insertion grooves 26, 26 which are spaced circumferentially at an angle of 180°. The bulb insertion groove 26, which is a so-called J-slot, serves to receive and engage with the round base bulb 1 in itself. However, the bulb insertion grooves 26 in this embodiment can receive the wedge base bulb 11. More particularly, as shown in FIG. 4, the bulb insertion groove 26 is provided with a guide part 27 which extends axially from an open end edge to a middle part. An engaging part 28 extends circumferentially to a clockwise direction in FIG. 1 from a lower end of the groove 26. The engaging part 28 is provided on its inner part with a recess 29 formed toward the open end edge of the bulb receiving portion 23. The opposite ends of the base 13 of the wedge base bulb 11 are firmly fitted in the guide parts 27 in the bulb insertion grooves 26.

When the pair of projections 6 on the base 3 are turned into the engaging parts 28 after the projections 6 are moved down along the guide parts 27, the round base bulb 1 is secured to the bulb receiving portion 23. Then, the projections 6 are fitted in the recesses 29 by an elastic force exerted in connection part 33 of a positive side contact piece 31 for the round base bulb 1, thereby preventing the projections 6 from turning back to the guide parts 27. On the other hand, the wedge base bulb 11 can be secured to the bulb receiving portion 23 when the opposite ends of the base 11 are inserted into the guide parts 27.

Figure 5:
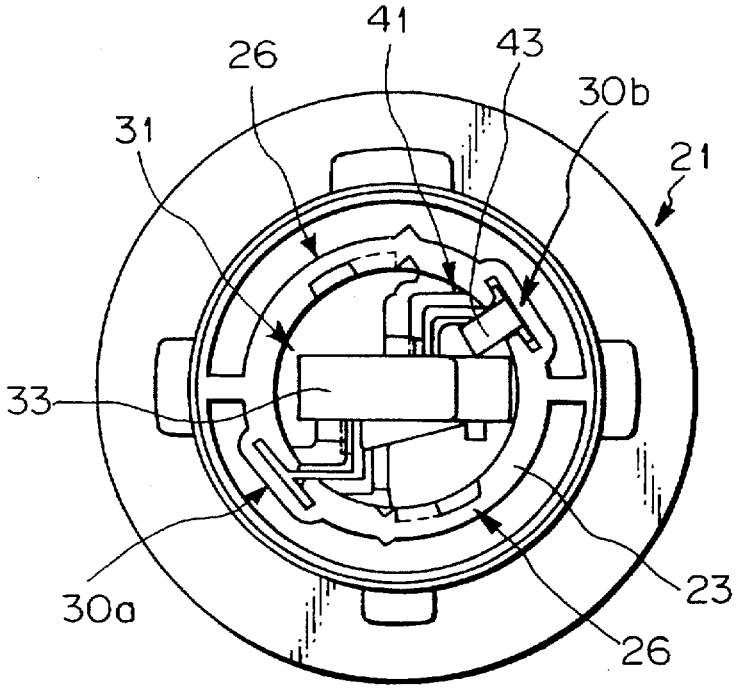
FIG. 5 is a plan view of the bulb socket in which a contact piece for the round base bulb is inserted.

As shown in FIG. 5, the bulb socket 21 is provided symmetrically in its interior with a pair of contact piece insertion grooves 30*a* and 30*b* which are shifted circumferentially from the bulb insertion grooves 26, 26. The contact piece insertion groove 30*a* receives a positive side contact piece 31 for the round base bulb 1 while the groove 30*b* receives a negative side contact piece 41 for the bulb 1. The respective contact piece insertion grooves 30*a* and 30*b* can receive contact pieces 61 for the wedge base bulb 11 (see FIGS. 12 and 14). The bulb socket 21 is formed into a thicker wall, which is bulged outwardly, at the portion in which the grooves 30*a* and 30*b* are provided.

Figure 6:
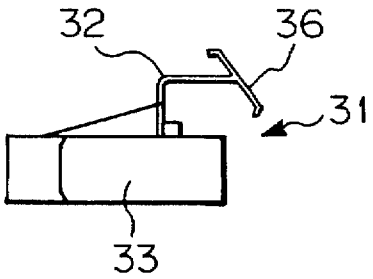
FIG. 6 is a plan view of a positive contact piece for the round base bulb.
Figure 7:
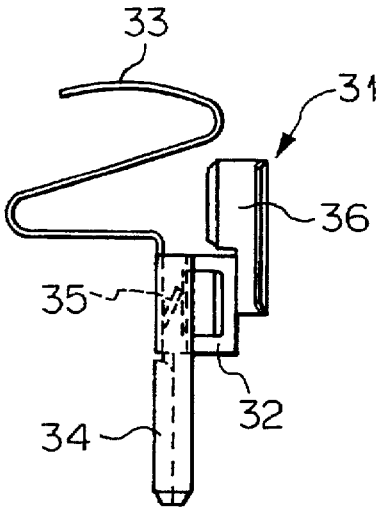
FIG. 7 is a front elevational view of FIG. 6.
Figure 8:
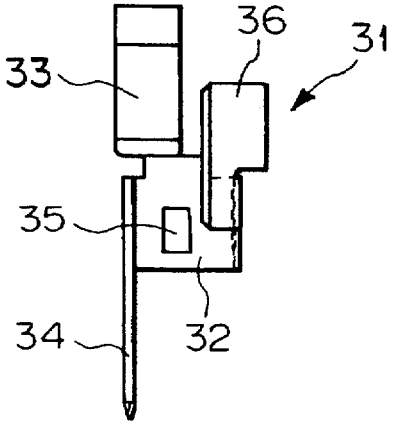
FIG. 8 is a side elevational view of FIG. 6.

Configurations of the pair of contact piece insertion grooves 30*a* and 30*b* are explained in detail below in connection with configurations of the contact pieces 31 and 41 for the round base bulb 1. The positive side contact piece 31 for the round base bulb 1 is shown in FIGS. 6 to 8. The contact piece 31 includes an L-shaped body 32 in plan view, an S-shaped contact part 33 which is provided on an upper face of one leg of the body 32 and adapted to resiliently contact with a positive side contact 4 on the base of the round base bulb 1, and a tab 34 which extends downwardly from the other leg of the body 32. The contact piece is formed from a sheet of metal together with each part by press working. The body 32 is provided on one leg thereof with an engaging piece 35 formed by cutting and bending and on the other leg thereof with a short fitting part 36 which extends perpendicularly to the other leg.

The positive side contact piece insertion groove 30*a* adapted to receive the positive side contact piece 31, as shown in FIG. 1, is provided in a thicker wall 39 with an introducing passage 50*a* which extends axially from the open edge of the bulb receiving portion 23 to the bottom face to receive the fitting part 36 of the contact piece 31 and is provided with a narrow channel 51*a* which is opened in an interior of the bulb receiving portion 23 to pass a proximal end of the body 32 through a lateral center part of the introducing passage 50*a*. The bulb receiving portion 23 is provided in the bottom face with an introducing slot 52*a* which is communicated with the channel 51*a* to receive the body 32 and is also provided in the bottom face with a through-hole 53*a* which is adapted to pass the tab 34.

When the fitting part 36 of the positive side contact piece 31 is fitted in the introducing passage 50*a* in the contact piece insertion groove 30*a* and is pushed down to the lower end of the passage 50*a*, the body 32 enters into the introducing slot 52*a* in the lower end face of the bulb receiving portion 23 through the channel 51*a*. When the engaging piece 35 fits in an engaging hole 54*a* in the slot 52*a*, the contact piece 31 is secured to the groove 30*a*. Then, the S-shaped contact part 33 is disposed near the lower end of the bulb receiving portion 23, as shown in FIG. 3, and the tab 34 extends through the through-hole 53*a* along a side face of a partition 24*a* in a male connector portion 24.

Figure 9:
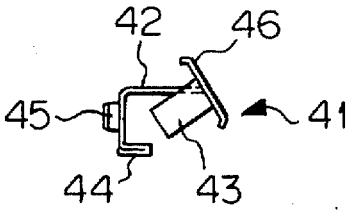
FIG. 9 is a negative side contact piece for the round base bulb.
Figure 10:
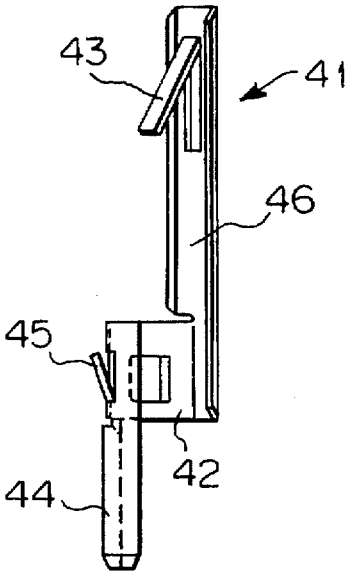
FIG. 10 is a front elevational view of FIG. 9.
Figure 11:
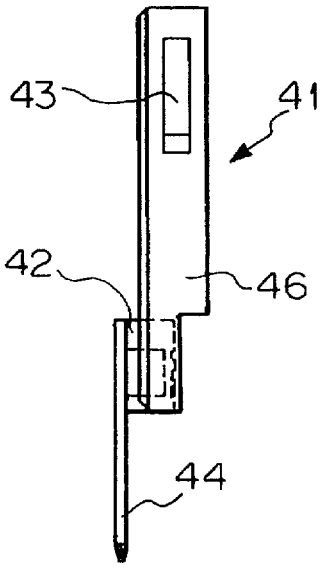
FIG. 11 is a side elevational view of FIG. 9.

A negative side contact piece 41 is shown in FIGS. 9 to 11. The negative side contact piece 41 includes an L-shaped body 42 in plan view and a tab 44 which is provided on one leg to extend downwardly. The contact piece 41 is formed from a sheet of metal together with each part by press working. The body 42 is provided on an upper face of the other leg thereof with a tall fitting part 46 which extends perpendicularly to the other leg. The fitting part 46 is provided on an upper side with a tongue-like connection part 43 which is cut and bent up inwardly to resiliently contact with a peripheral face of a negative side contact 5 on the base 3 of the round base bulb 1. The body 42 is also provided with an engaging piece 45.

The negative side contact piece insertion groove 30*b* adapted to receive the negative side contact piece 41 as shown in FIG. 1, is provided in the thicker wall with an introducing passage 50*b* which extends axially from the open edge of the bulb receiving portion 23 to the bottom face to receive the fitting part 46 of the contact piece 41 and is provided with a wide channel 51*b* which is opened in an interior of the bulb receiving portion 23 from the lateral center part of the passage 50*b*. The channel 51*b* permits a proximal end of the body 42 to pass therethrough and a tongue-like connection part 43 to project inwardly therethrough. The bulb receiving portion 23 is provided in the bottom face with an introducing slot 52*b* which is communicated with the channel 51*b* and is also provided with a through-hole 53*b* which is adapted to pass the tab 44.

When the fitting part 46 of the negative side contact piece 41 is fitted in and pushed down in the introducing passage 50*b* in the contact piece insertion groove 30*b*, the body 42 enters into the introducing slot 52*b* in the lower end face of the bulb receiving portion 23 through the channel 51*b*. When the engaging piece 45 fits in the engaging hole 54*b* in the slot 52*b*, the contact piece 41 is fixed in the slot 30*b*. Then, as shown in FIG. 3, the tongue-like connection part 43 extends through the channel 51*b* to the interior of the bulb receiving portion 23 and the tab 44 extends through the through-hole 53*b* along the other side face of the partition 24*a* in the male connector portion 24.

Figure 15:
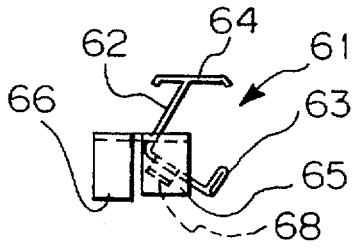
FIG. 15 is a plan view of the contact piece for the wedge base bulb.
Figure 16:
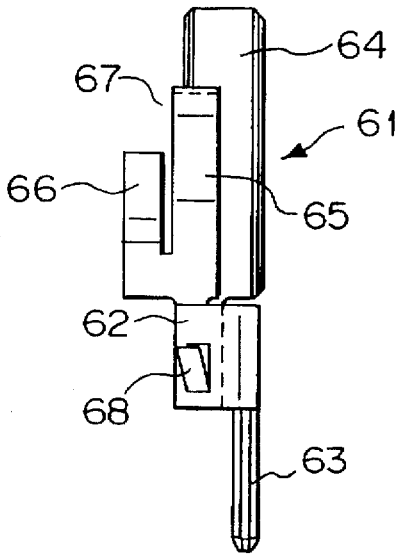
FIG. 16 is a front elevational view of FIG. 15.
Figure 17:
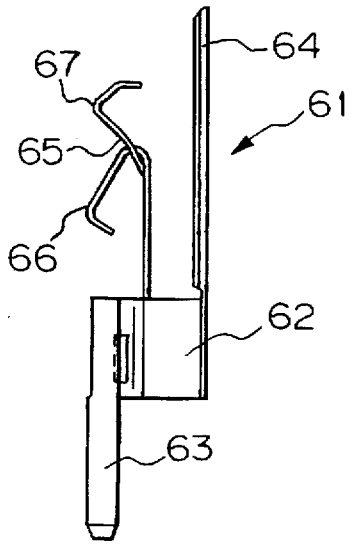
FIG. 17 is a side elevational view of FIG. 15.

Each of the contact piece insertion grooves 30*a* and 30*b* described above can receive the contact piece 61 for the wedge base bulb 11. The contact pieces 61 for the wedge base bulb 11 are of the same configuration in both positive and negative sides, as shown in FIGS. 15 to 17. The contact piece 61 includes an L-shaped body 62 in plan view, a tab 63 which is provided on one leg of the body 62 to project downwardly, and a tall fitting part 64 which is provided on an upper face of the other leg of the body 62 perpendicularly. The body 62 is provided on an upper face of a bent portion of the body 62 with a tall stopper 65 and a short connection piece 66 which are juxtaposed on the upper face. The contact piece is formed of a sheet of metal together with each part.

The resilient stopper 65 engages with the first projection 15 on the side face of the base 13 of the wedge base bulb 11 to prevent the bulb 11 from coming out of the socket 21. As shown in FIG. 17, the stopper 65 is provided on its upper end with a bent part 67 adapted to engage with an upper face of the first projection 15. The connection piece 66 is adapted to resiliently contact with the contact 18 of the wedge base bulb 11. The connection piece 66 is bent down inwardly at the upper end and bent perpendicularly and outwardly at the distal end to elastically push the contact 18 of the bulb 11. The body 62 is provided with an engaging piece 68.

When the fitting part 64 of the contact piece 61 is fitted in and pushed down in the introducing passage 50*a* or 50*b* in the contact piece insertion groove 30*a* or 30*b*, the body 62 enters through the channel 51*a* or 51*b* into the introducing slot 52*a* or 52*b* in the lower end face of the bulb receiving portion 23. When the engaging piece 68 fits in the engaging hole 54*a* or 54*b* in the introducing slot 52*a* or 52*b*, the contact piece 61 is fixed in the contact piece insertion groove 30*a* or 30*b*. Then, the tab 63 extends through the through-hole 53*a* or 53*b* to the interior in the male connector part 24.

Figure 14:
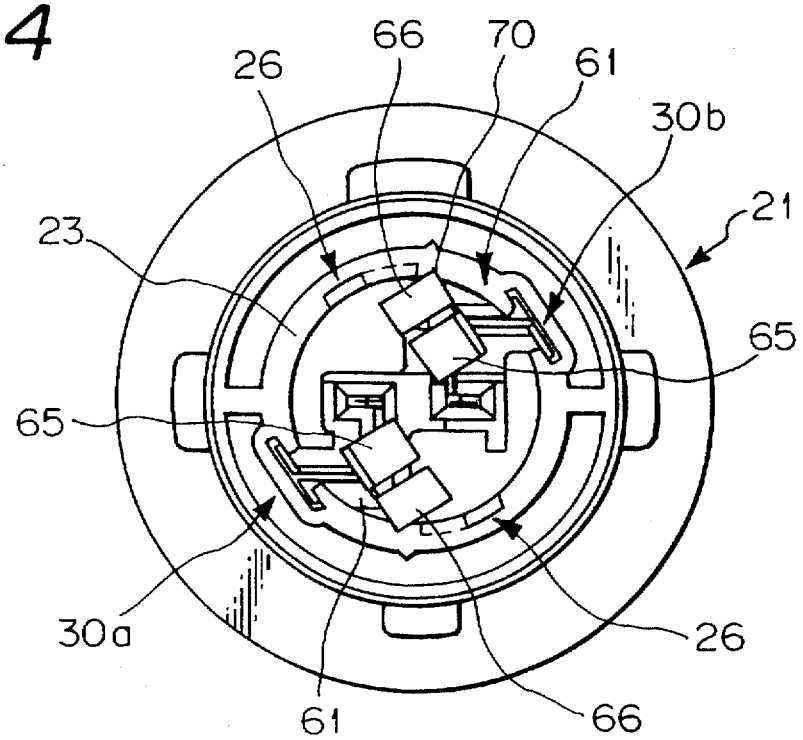
FIG. 14 is a plan view of the bulb socket in which a contact piece for the wedge base bulb is inserted.

As shown in FIG. 14, the stopper 65 and connection piece 66 of the contact pieces 61 and 61 are disposed cross a space defined between the guide parts 27, 27 in the bulb insertion grooves 26, 26, which serves as an insertion space for the base 13 of the wedge base bulb 11. In this case, the stopper 65 and connection piece 66 are disposed on an inner peripheral side and an outer peripheral side, respectively.

Since a part of the connection piece 66 on the outer peripheral side interferes with the inner peripheral face of the bulb receiving portion 23, the bulb insertion groove 26 is provided in its side face with a longitudinal escape slot 70 which permits the connection piece 66 to enter thereinto, as shown in FIGS. 1 and 4.

The bulb receiving portion 23 is provided on its outside with a double cylinder 71. The cylinder 71 is provided on its outer periphery with four engaging projections 72 which are spaced circumferentially at an angle of 90° and is also provided on the outer periphery with a flange 73 which is spaced axially by a given distance in a lower position from the engaging projections 72. A panel for a lighting fixture (not shown) on which the bulb socket 21 is mounted is provided with an attaching hole in which the cylinder 71 is fixed. The attaching hole is provided in its periphery with four escape recesses which fit the perspective projections 72. By fitting the cylinder 71 in the attaching hole so that the engaging projections 72 can pass through the escape recesses and turning the bulb socket 21 after the flange 73 contacts with the panel, the opposite mouth edges of the attaching hole are clamped between the flange 73 and the engaging projections 72 which are disposed on the rear side of the panel, thereby securing the bulb socket 21 to the lighting fixture panel. The male connector portion 24 is provided on its outer periphery with an engaging portion 75 which is adapted to engage with a mating female connector, as shown in FIG. 3.

An operation of this embodiment will be explained below.

In the case of attaching the round base bulb 1 to the bulb socket 21, the positive and negative side contact pieces 31 and 41 for the round base bulb 1 are inserted into the bulb receiving portion 23 through the corresponding contact piece insertion grooves 30*a* and 30*b*. Then, as shown in FIGS. 3 and 5, the S-shaped connection part 33 of the positive side contact piece 31 is disposed on the lower end face of the bulb receiving portion 23 while the tongue-like connection part 43 of the negative side contact piece 41 extends to the interior in the bulb receiving portion 23. The respective tabs 34 and 44 extend to the interior in the male connector portion 24.

Figure 18:
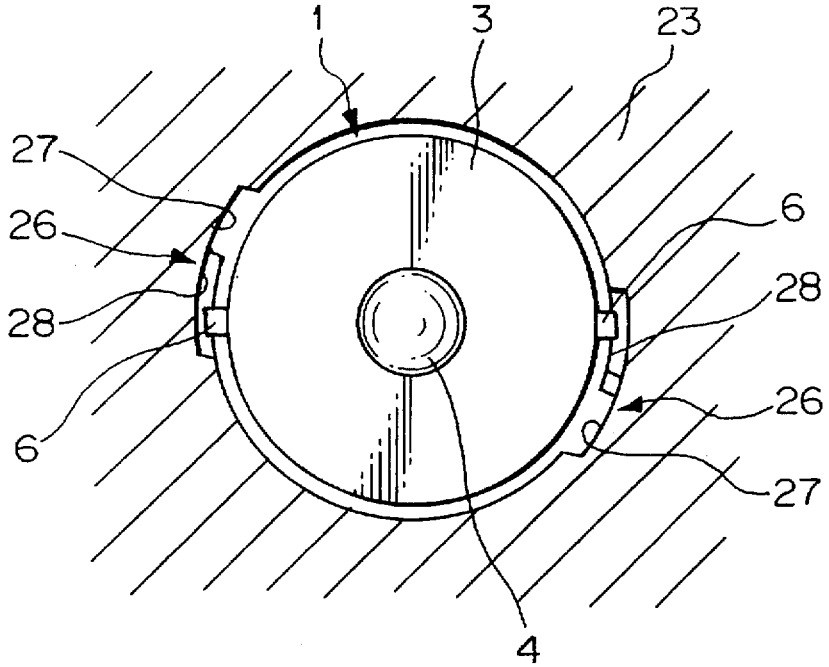
FIG. 18 is a cross sectional view taken from the bottom side of the bulb socket in which the round base bulb is inserted.

When the base 3 of the bulb 1 is fitted in the bulb receiving portion 23, the projections 6 on the base 3 are fitted in the inlet of the guide parts 27 in the bulb insertion grooves 26 by turning the bulb 1 in both directions and are pushed down into the guide parts 27, the base 3 is inserted into the bulb receiving portion 23 while elastically deforming the connection part 31 of the positive side contact piece 31. When the bulb 1 is turned to a clockwise direction after the opposite projections 6 contact with the lower end of the guide part 27, as shown in FIG. 18, the projections 6 enter into the engaging part 28. When a pushing force to the bulb 1 is removed, the bulb 1 is lifted up slightly by an elastic recovery force exerted in the connection part 33 of the positive side contact piece 31, so that the projections 6 enter into the recesses 29, thereby securing the bulb 1 to the bulb receiving portion 23. Then, the positive side contact 4 on the base 3 of the bulb 1 is resiliently pressed onto the connection part 33 of the positive contact piece 31 while the negative side contact 5 is resiliently pressed onto the connection part 43 of the negative side contact piece 41, thereby making an electrical connection between the bulb 1 and the bulb socket 21.

In the case of detaching the round base bulb 1 from the bulb socket 21, by turning the bulb 1 to the counter-clockwise direction while pushing the bulb 1 against the elastic force of the positive side connection part 33, the projections 6 are returned to the guide parts 27 through the engaging recesses 28 and then the bulb 1 can be withdrawn from the bulb socket 21 through the guide parts 27.

In the case of attaching the wedge base bulb 11 to the bulb socket 21, by inserting the two contact pieces 61, 61 for the wedge base bulb 11 into the contact piece insertion grooves 30*a*, 30*b* and fitting a part of the connection piece 66 in the escape slot 70, the bulb 11 is inserted into the bulb receiving portion 23. Thus, the stopper 65 and connection piece 66 of the respective contact pieces 61, 61 as shown in FIGS. 12 and 14, are disposed cross an insertion space for the base 13 of the wedge base bulb 11. The respective tabs 63, 63 extend into the interior in the male connector portion 24.

The opposite ends of the base 13 of the wedge base bulb 11 are inserted into the guide parts 27 in the bulb insertion grooves 26, 26. In this case, the wedge base bulb 11 is turned at an angle of 45° to the direction shown by an arrow from the position shown in FIG. 12 and inserted into the bulb socket 21. Since the base 13 is set to be firmly fitted in the guide parts 27, 27, as shown in FIG. 19, the wedge base bulb 11 are positioned unrotatably in the bulb socket 21. Since the second projections 16 and third projections 17 on the opposite sides of the base 13 are firmly fitted in the inner periphery of the bulb receiving portion 23, the base 13 does not shake in the widthwise direction.

Figure 20:
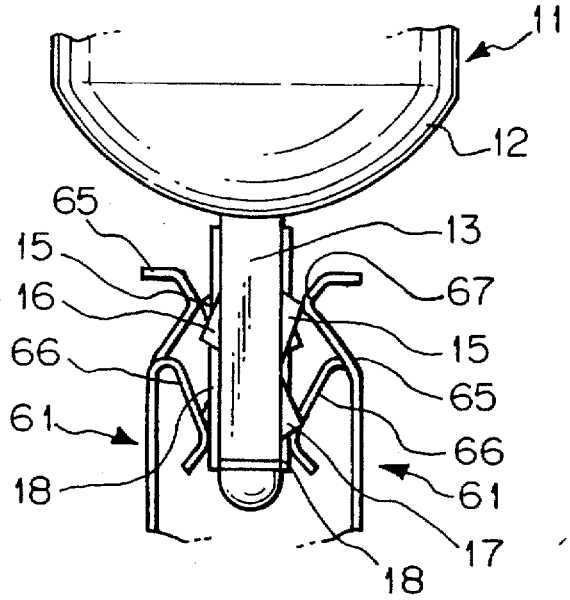
FIG. 20 is a fragmentary front elevational view of the wedge base bulb which is being inserted into an engaging position.
Figure 21:
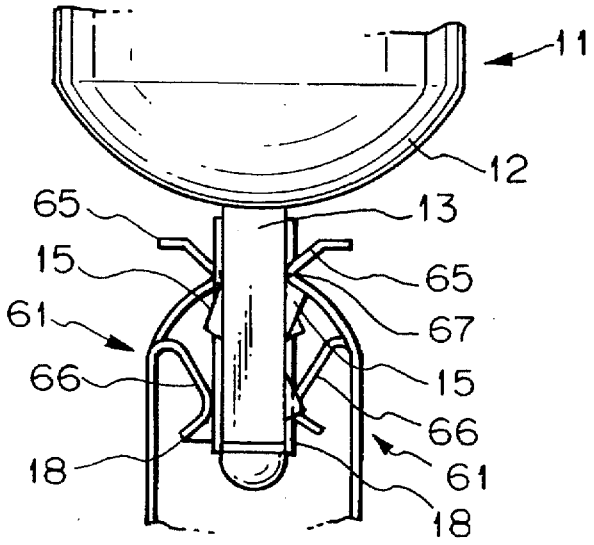
FIG. 21 is a fragmentary front elevational view of the wedge base bulb which is inserted into the engaging position.

When the wedge base bulb 11 is further pushed down into the bulb socket 21, the first projections 15, 15 on the opposite sides of the base 13 contact with the bent parts 67 of the stopper 65 and move down while pushing the bent parts 67 outwardly against their elastic resistances, as shown in FIG. 20. When the first projections 15 slide over the bent parts 67, both stoppers 65 return inwardly to the original position by means of their elastic forces, as shown in FIG. 21 and the bent parts 67 engage with the upper faces of the first projections 15, thereby securing the wedge base bulb 11 to the bulb socket 21. Meanwhile, the respective contact pieces 66 slide on the corresponding contacts 18 while being elastically deformed and the pieces 66 are resiliently pressed onto the contacts 18 when the bulb 11 is secured to the socket 21, thereby making an electrical connection therebetween.

In the case of detaching the wedge base bulb 11 from the bulb socket 21, the bulb 11 is merely withdrawn while the stoppers 65 of both contact pieces 61 are bent outwardly against their elastic resistances.

According to this embodiment, since the round base bulb 1 and wedge base bulb 11 can be received through the respective contact pieces 31, 41, and 61 in the common bulb socket 21, it is possible to reduce the number of elements and the producing cost.

What is claimed is:

1. A bulb socket assembly comprising a socket body and one of a first pair of positive and negative contact pieces for a round base bulb and a second pair of positive and negative contact pieces for a wedge base bulb, said socket body being provided in an end thereof with:

a bulb receiving hole adapted selectively to hold either a base of a round base bulb or a base of a wedge base bulb; and the other end with a rectangular connector portion with an outwardly engaging portion thereon;

a pair of bulb insertion grooves having a portion extending axially from an open edge of said bulb receiving hole to an inner part in an interior of the bulb receiving hole, said bulb insertion grooves comprising a guide portion extending axially in each of the grooves adapted to hold opposite ends of the base of said wedge base bulb, and engaging parts therein provided with recesses adapted to receive a pair of projections on the base of said round base bulb and in which the bulb receiving hole is provided with a pair of contact piece holders constructed and arranged to receive either of said first pair of positive and negative contact pieces for the round base bulb or said second pair of positive and negative contact pieces for the wedge base bulb depending on the type of bulb to be inserted into the socket.

2. The bulb socket of claim 1 wherein a positive contact piece for said round base includes a first body, L-shaped in plan view, an S-shaped contact part on an upper face of said first body and adapted to resiliently contact said positive contact, a tab projecting into a male connector portion, an engaging piece on said first body, adapted to mate with a corresponding opening in said socket to retain said first body in said receiving hole, and a relatively short fitting part on said first body, said fitting part adapted to be received by one of said insertion grooves when said round base is in said bulb receiving hole.

3. The bulb socket of claim 2 comprising a negative contact piece including a second body, L-shaped in plan view, a tab on said second body projecting into said male connector portion, a relatively tall fitting part on said second body, adapted to be received by another of said insertion grooves, and provided with an inwardly bent tongue, said tongue adapted to resiliently contact said negative contact on said base, and an engaging piece on said second body adapted to mate with a corresponding opening in said socket to retain said second body in said receiving hole.

4. The bulb socket of claim 1 wherein each of said insertion grooves is adapted to receive a contact piece on said L-shaped body, each of said grooves having a radially outwardly thickened wall.

* * * * *